US006302320B1

(12) United States Patent
Stout

(10) Patent No.: US 6,302,320 B1
(45) Date of Patent: Oct. 16, 2001

(54) HEAVY DUTY ARTICLE CARRIER

(75) Inventor: James T. Stout, Ellijay, GA (US)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 08/372,532

(22) Filed: Jan. 13, 1995

(51) Int. Cl.[7] ..... B65D 5/468
(52) U.S. Cl. ..... 229/117.13
(58) Field of Search ..... 206/427, 428; 229/117.13, 117.12, 117.09, 117.16, 117.17

(56) References Cited

U.S. PATENT DOCUMENTS

| | | | | |
|---|---|---|---|---|
| 2,841,279 | | 7/1958 | Forrer | 206/141 |
| 4,314,639 | * | 2/1982 | Gloyer | 229/117.13 X |
| 4,577,799 | | 3/1986 | Oliff | 229/198.2 |
| 4,588,084 | * | 5/1986 | Holley, Jr. | 206/427 |
| 4,830,267 | * | 5/1989 | Wilson | 206/427 X |
| 4,989,778 | * | 2/1991 | Saulas | 229/117.13 |
| 5,065,937 | | 11/1991 | Ritter | 229/117.13 |
| 5,197,598 | | 3/1993 | Stout et al. | 206/141 |
| 5,221,041 | | 6/1993 | Stout et al. | 229/117.13 |
| 5,221,042 | | 6/1993 | Oliff | 229/117.13 |
| 5,307,932 | | 5/1994 | Stout et al. | 206/141 |
| 5,333,734 | * | 8/1994 | Stout et al. | 229/117.13 X |
| 5,379,944 | * | 1/1995 | Stout et al. | 229/117.13 |
| 5,385,234 | * | 1/1995 | Stout et al. | 229/117.13 X |

FOREIGN PATENT DOCUMENTS

| | | | | |
|---|---|---|---|---|
| 877792 | * | 8/1971 | (CA) | 229/117.13 |
| 1229325 | | 11/1987 | (CA) . | |
| 2274509 | * | 1/1976 | (FR) | 229/117.13 |

* cited by examiner

*Primary Examiner*—Stephen P. Garbe
(74) *Attorney, Agent, or Firm*—Michael V. Drew

(57) ABSTRACT

A carrier 10 has a bottom wall (24), side walls (22, 26), a top wall (20), and end walls. At least one of the end walls is is a composite structure of multiple-ply construction. The composite end wall is made up of multiple end wall flaps (40, 42, 44, 46) in face-to-face relation with respect to one another with a hand-hole handle structure formed from hand-hole apertures **(48, 48*a*, 48*b*, 49, 49*a*, 49*b*) in each of the flaps aligned over one another. In each end wall flap score lines (51, 52, 53, 54, 55, 56, 61, 62, 63, 64, 65, 66, 71, 72, 73, 74, 75, 76, 81, 82, 83, 84, 85, 86) extend from the respective ends of each aperture generally toward a corner of the flap. One of the score lines (62, 65, 82, 85) in each set extending from each aperture (48*a*, 48*b*, 49*a*, 49*b*) is coincident with a supplemental score line (25, 27) which extends from the end edge of the adjoining side wall (22, 26). The supplemental score lines (25, 27) extend from the end edge of the side wall (22, 26) generally to a point of intersection of the respective side wall score line (23) with the respective top or bottom edge of the side wall (22, 26). Each side wall score line (23) is parallel with the edge of intersection between the side wall (22, 26)** and adjoining end wall.

9 Claims, 3 Drawing Sheets

HEAVY DUTY ARTICLE CARRIER

BACKGROUND OF THE INVENTION

The invention relates generally to hand-carried article carriers, and more particularly to hand-gripping apertures and related score lines in the end and side walls of such carriers.

BACKGROUND ART

One of the problems in producing hand-carried article carriers with hand-gripping apertures is that the handle area of the carrier, which includes and is generally defined by the hand-gripping apertures, is subjected to substantial stress when the loaded carrier is lifted. The weight of the contents of the carrier causes the carrier to sag and results in tears along randomly occurring stress lines. This is particularly a problem in paperboard carriers where it is desirable to use paperboard of minimum thickness to obtain a cost savings. Thus, a primary objective in the design of hand-carried article carriers with aperture-formed handles, particularly those made of paperboard, is to prevent tearing of the carrier in and around its handle structure. A means of alleviating tearing caused by weight stress is to use score lines to re-direct stress. Examples of previous patents which disclose and claim hand-carried article carriers having hand-gripping apertures with score lines that re-direct stress in the carrier are U.S. Pat. No. 5,333,734, U.S. Pat. No. 5,307,932, and U.S. Pat. No. 5,197,598, all inventions of James Stout and James DeMaio assigned to the assignee of the present invention. What is needed, however, is a means for alleviating tearing in a carrier, particularly a paperboard carrier, while also enabling the carrier to be made from substantially thinner sheets of material.

SUMMARY OF THE INVENTION

In a preferred embodiment of the invention a carrier has a bottom wall with side and end edges; side walls having end, top and bottom edges with the bottom edges foldably joined to the side edges of the bottom wall; a top wall having opposed side and end edges with the side edges joined to the top edges of the side walls; and end walls having bottom, top and side edges with the bottom edges joined to respective edges of the bottom wall, the side edges joined to respective end edges of the side walls, and the top edges joined to respective opposed end edges of the top wall. At least one of the end walls is a composite structure of multiple-ply construction. The composite end wall is made up of multiple end wall flaps in face-to-face relation with respect to one another with a hand-hole handle structure formed from hand-hole apertures in each of the flaps aligned over one another. In each end wall flap score lines extend from the ends of each aperture generally toward a corner of the panel. One of the score lines extending from each aperture is coincident with a supplemental score line which extends from the end edge of the adjoining side wall. The supplemental score lines extend from the end edge of the side wall generally to a point of intersection of the respective side wall score line and the respective top or bottom edge of the side wall. Each side wall score line is parallel with the edge of intersection between the side wall and adjoining end wall. In one preferred embodiment the score lines in the end walls diverge toward the corners of the end wall. In another preferred embodiment the end wall score lines are parallel. A hand hole flap for covering each outermost hand hole has diverging score lines that promote folding about containers loaded in the carrier.

The present invention provides a carrier which is typically reinforced in a wall which now contains the handle, that is, the multiple-ply end wall. Score lines in the end wall multiple flaps distribute stress forces away from critical, tearable points. Thinner sheets of material, particularly paperboard, may be used to construct the carrier because the stress-receiving handle structure is formed in a multiple-ply end wall which employs stress-directing score lines. A cost savings may be realized because the handle structure for the carrier is not formed in the top wall. The top wall is normally only one- or two-ply. The handle structure is formed in an end wall which is normally a four-ply composite structure and thus does not require an increase in the amount of carrier material normally necessary.

Other advantages and objects of the present invention will be apparent from the following description, the accompanying drawings, and the appended claims.

DETAILED DESCRIPTION OF THE PREFERRED EMBODIMENT

Figure 1:
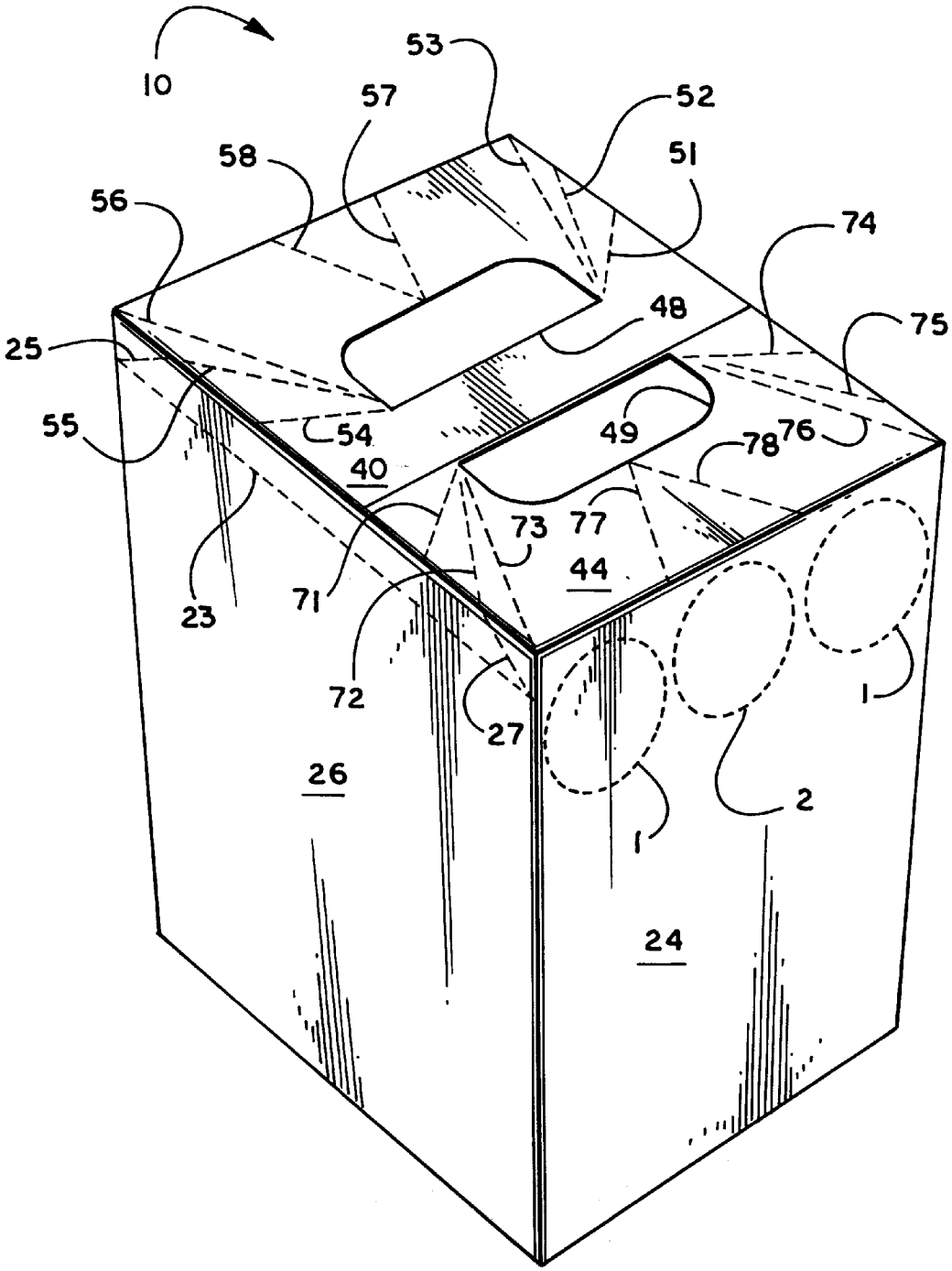
FIG. 1 is an isometric illustration of a heavy duty article carrier in accordance with a preferred embodiment of the present invention.
Figure 2:
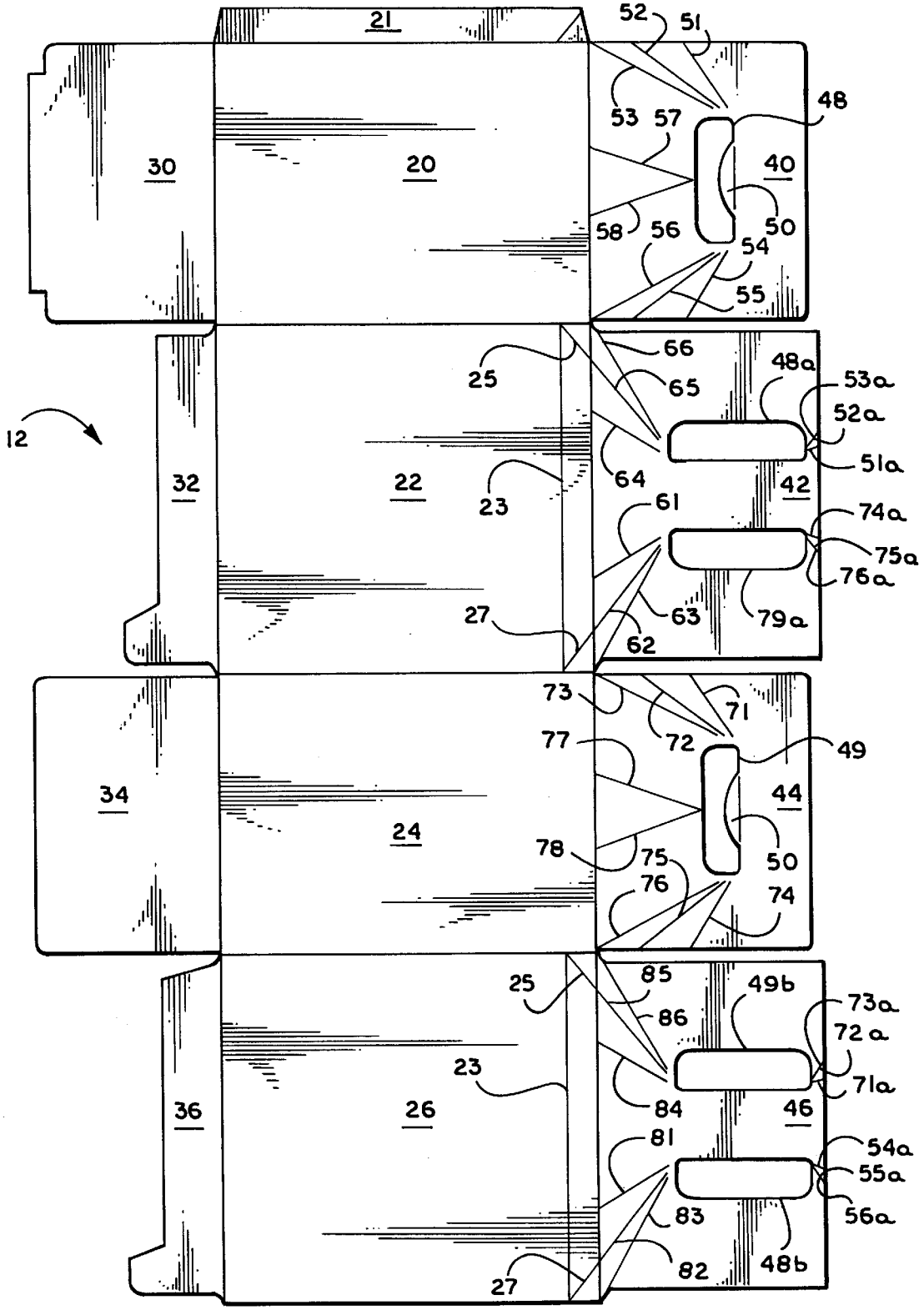
FIG. 2 is a plan view of a blank for forming the article carrier of FIG. 1.

Referring first to FIG. 1 therein is shown in isometric illustration a heavy duty article carrier 10 in accordance with a preferred embodiment of the invention. The article carrier 10 is of the type used for packaging multiple items such as beverage cans or bottles. The article carrier 10 is of the type particularly useful for packaging multiple tiers of beverage cans. In FIG. 1, the article carrier 10 is shown standing upon one end with the other end being topmost in the illustration. The bottoms of cans 1, 2 are shown in phantom illustration through the bottom wall 24 of the carrier 10. The bottom 24 and top walls (not visible in this view) are generally the same, as are the side walls, of which one such side wall 26 is visible in FIG. 1. The article carrier 10 is designed to be grasped from one of its ends. The topmost end in the view of FIG. 1 illustrates the end wall structure which facilitates grasping. Before discussing the elements of the end wall and grasping structure, reference will now be made simultaneously to FIG. 1 and FIG. 2 to discuss other features of the carrier 10. FIG. 2 illustrates a blank 12 according to a preferred embodiment of the invention suitable for erecting the article carrier 10. Although the top and bottom walls of the carrier 10 are identical and interchangeable, for convenience the top and bottom walls 20, 24 are respectively designated by distinct reference numerals 20, 24. The side walls 22, 26 are foldably joined to the top 20 and bottom 24 walls. A sidewall flap 21 foldably joined to the top wall and attachable to the free edge of the side wall 26 enables the blank 12 to be formed into a sleeve. Although both ends of the carrier 10 could be constructed identically the novel composite wall feature of the invention, discussed in detail below, is shown illustrated at only one end. The closure structure at the other end of the carrier is formed from end flaps 30, 32, 34, 36.

Instead of the traditionally used top wall as the means for grasping a carrier, the invention utilizes a stress-directing composite end wall containing a handle structure as the means for grasping the carrier 10. Stress directing lines are also formed in the side walls of the carrier. Referring again simultaneously to FIGS. 1 and 2, the end wall which contains grasping means is a composite wall formed from four plies of carrier material, namely, the end flaps 40, 42, 44, 46 foldably attached to respective top 20, side 22, bottom 24, and side 26 wall panels. The stress-directing lines in the four flaps 40, 42, 44, 46 cause a bagging effect in the composite end wall when the four plies are overlaid to form a closure for the end of the carrier 10 and the carrier 10 is lifted by the handle structure formed in the composite end wall. Each end flap 40, 42, 44, 46 is designed to be placed in flat face relation with another and has at least one hand (or finger) hole 48, 48*a*, 48*b*, 49, 49*a*, 49*b* and stress-directing lines aligned to overlap or be overlapped by those features in another flap. The hand hole handle structure is designed for the insertion of fingers and/or adjoining portions of the hand. Although a single hand hole handle structure would work a pair of spaced apart elongated finger-receiving hand-hole apertures enables the carrier to be lifted by a band formed between the hand holes 48, 48*a*, 48*b*, 49, 49*a*, 49*b*. In the preferred embodiment, the hand holes are positioned so that the longitudinal orientation or axes of the elongated hand holes are parallel to the top 20 and bottom 24 panels of the carrier 10. The stress directing lines may be score lines or perforated lines or lines which are a combination thereof. For convenience, the stress-directing lines will be referred to as score lines. Further, for convenience, the stress-directing score lines radiating from the end regions of the handle structure toward the corners of the end wall are considered the first sets of or "first" score lines. In comparison, for convenience of reference the diverging score lines radiating from middle region of the handle, between the first sets of score lines, are considered second sets of or "second" score lines. The top end flap 40 has a group of multiple score lines 51, 52, 53 and 54, 55, 56 extending divergingly from each end region of the hand hole 48 toward the closest corner of the erected carrier 10. Mediate score lines 57, 58 extend divergingly from the hand hole 48 to the line demarking the edge between the top panel 20 and the top end flap 40. The bottom end flap 44 contains a hand hole 49 and stress-directing score lines 71, 72, 73, 74, 75, 76, 77, 78 arranged similar to those contained in the top end flap 40. Each hand hole 48, 49 in the top and bottom end flaps 40, 44 is the outermost grasping aperture in an erected carrier and, thus, may also have a cushion flap 50 for alleviating the pressure placed upon an inserted hand or finger. Referring momentarily particularly to FIG. 1, therein in the bottom wall panel 24 can be seen the manner in which the mediate score lines 77, 78 (which are comparable to the mediate score lines 57, 58) diverge generally to either side of a centrally-located cylindrical article 2 which would be packaged in the carrier 10. For reference, cylindrical articles 1 located on the ends of the carrier are also shown. The carrier is designed to accommodate cylindrical articles 1, 2 which extend longitudinally parallel to the side walls 22, 26 and end walls of the erected carrier 10. Referring again simultaneously to FIGS. 1 and 2, the top 40 and bottom 44 end flaps are designed to overlie the side end flaps 42, 44 and to overlap one another along a strip extending between each respective hand hole 48, 49 and the edge of the respective end flap 40, 44 in the erected carrier 10.

Referring now particularly to FIG. 2, each side end flap 42, 44 has a respective pair of hand holes 48*a*, 49*a*, and 48*b*, 49*b*. The side end flaps 42, 46 are foldably joined to the respective side walls 22, 26 and are designed so that when the side end flaps 42, 46 are overlapped face to face the hand hole denoted by numeral 48*a* is aligned with the hand hole denoted by numeral 48*b* and the hand hole denoted by numeral 49*a* is aligned with the hand hole denoted by numeral 49*b*. Referring now particularly to FIG. 1, the side end flaps 42, 46 are overlaid by the top 40 and bottom 44 end flaps. As previously mentioned, the portion of the top end flap 40 between the hand hole 48 and the unattached edge of the flap 40 overlies a corresponding portion of the bottom end flap 44 which lies between the hand hole 49 and the unattached edge of the flap 44 when the two flaps 40, 44 are placed face to face to complete the end closure. Thus, in the closed carrier 10 hand holes 48, 48*a*, 48*b* are in alignment and hand holes 49, 49*a*, 49*b* are in alignment. Furthermore, the sets of score lies associated with each hand hole are likewise oriented under one another. That is, score lines in the top end flap 40 denoted 51, 52, 53 are aligned over score lines in the side end flap 46 respectively denoted 81, 82, 83 and the abbreviated score lines in end flap 42 respectively denoted 51*a*, 52*a*, 53*a*. Score lines in the top end flap 40 designated 54, 55, 56 are aligned over score lines in the side end flap 42 respectively designated as 64, 65, 66 and the abbreviated score lines in side end flap 46 respectively denoted 54*a*, 55*a*, 56*a*. Likewise, the score lines in the bottom end flap 44 denoted 71, 72, 73 are aligned over the score lines in the side end flap 42 respectively denoted 61, 62, 63 and the abbreviated score lines in the side end flap 46 respectively denoted 71*a*, 72*a*, 73*a*. And, in like fashion, the score lines in the bottom end flap 44 denoted 74, 75, 76 are aligned over the score lines in the side flaps 46 respectively denoted 84, 85, 86 and the abbreviated score lines in the side end flap 42 respectively denoted 74*a*, 75*a*, 76*a*. While continuing to refer to figs. 1 and 2, reference is made to the supplementary score lines 25, 27 in the side walls 22, 26 which extend from the end edge of the carrier 10 from a point generally intersecting respective score lines 65, 85 and 62, 82 to respective top and bottom edges of the side walls 22, 26 to intersect with either end of a side score line 23. Each side score line 23 is generally parallel to the end edge of the respective side wall 22 26 of the carrier 10 and spaced therefrom.

The arrangement of the score lines described above encourages a bagging effect in the composite end wall of the carrier 10 when the end of the carrier 10 is closed and the carrier is lifted by the handle area formed between the handle holes 48, 49. When the carrier 10 is lifted by the handle area the various score lines in the end flaps 40, 42, 44, 46 cause "bagging" or "tenting" of the end wall about the score lines. Through this mechanism stress is directed to the top 20, bottom 24, and side 22, 26 wall panels thus relieving stress upon the end wall which would otherwise cause the handle area to shear away from the end wall. The score lines 23, 25, 27 in the side walls 22, 26 10 further help direct stress along the sleeve-forming walls of the carrier 10.

Figure 3:
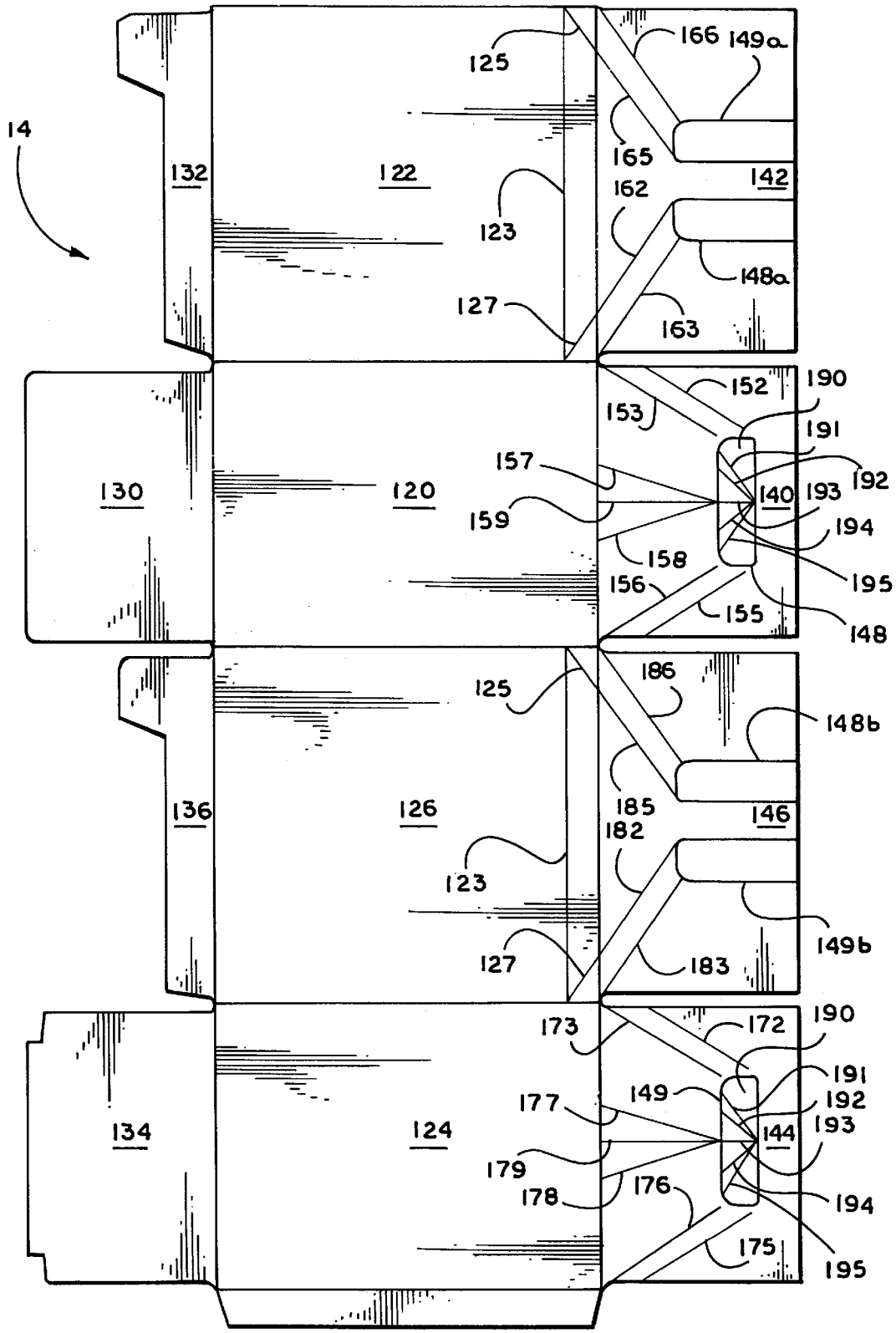
FIG. 3 is a plan view of an alternate blank for forming a heavy duty article carrier according to another preferred embodiment of the invention.

Although the preferred embodiment depicted shows a set of three score lines extending from the corner portion of each hand hole, fewer than or greater than three may be used, and lines that do not necessarily converge may also be used. For example, referring now to FIG. 3, therein is shown a carrier blank 14 according to another preferred embodiment of the invention. FIG. 3 uses the same system of reference numerals as is used in FIG. 2 except in a 100 series. In the carrier blank 14 of FIG. 3 a pair of parallel score lines extend from each end of each hand hole 148, 148*a*, 148*b*, 149, 149*a*, 149*b*. The truncated hand holes 148*a*, 149*a*, 148*b*, 149*b* do not extend the full length of the full hand holes 148, 149. To illustrate an alternate embodiment of the mediate score lines 57, 58 and 77, 78 which are shown in FIG. 2, the carrier blank 14 of FIG. 3 illustrates a third mediate, or bisecting, score line 159, 179 between the diverging lines 157, 158 and 177, 178 in each set of mediate score lines, as opposed to only the diverging pair. The carrier blank 14 of FIG. 3 also illustrates the use of a hand hole flap 190 to cover the hand holes 148, 149 which would be outermost in the erected, closed carrier. The hand hole flaps 190 have score lines 191, 192, 193, 194, 195 which encourage deformation of the hand hole flaps 190 about the bodies of cylindrical articles lying beneath the flaps 190 in a loaded carrier. The flaps 190 provide a cover for the only opening to the fully enclosed erected carrier thereby preventing debris or other undesirable items from entering the handle opening of the end-graspable carrier.

Other modifications may be made in the foregoing without departing from the scope and spirit of the claimed invention.

What is claimed is:

1. An article carrier comprising:

a sleeve formed from a plurality of panels foldably joined to one another;

end closure for each end of said sleeve at least one said end closure being a composite wall having a plurality of flaps overlapping in face contacting relationship with one another foldably joined respectively to said plurality of panels and having a handle defined by at least one finger-receiving hand-hole aperture extending through each of said plurality of flaps with said at least one finger-receiving hand-hole aperture in one of said plurality of flaps positioned for coincident alignment with said at least one finger-receiving hand-hole aperture in another of said plurality of flaps, each of said plurality of flaps having at least one first score line extending from a region of said finger-receiving hand-hole aperture that is proximate a corner of said flap towards a corner of said composite wall to an edge of said flap, said at least one first score line in one of said plurality of flaps positioned for coincident alignment with a similarly positioned said at least one first score line in another of said plurality of flaps.

2. The article carrier of claim 1, wherein a plurality of said at least one first score line comprise diverging score lines.

3. The article carrier of claim 1, wherein a plurality of said at least one first score line comprise parallel score lines.

4. The article carrier of claim 1, wherein said panels comprise a top wall and an opposing bottom wall interconnected by opposing side walls, wherein said at least one finger-receiving hand hole aperture is elongated having a longitudinal axis parallel to said top and bottom walls, wherein outermost ones of said composite wall flaps have a pair of diverging second score lines mediate said at least one first score line and extending from said least one finger-receiving hand hole aperture to an edge of intersection of said outermost ones of said composite wall flaps and respective said top and bottom walls.

5. The carrier of claim 4, further comprising a bisecting third score line extending from said at least one finger-receiving hand hole aperture to said edge of intersection of said outermost ones of said composite wall flaps and said respective said top and bottom walls bisecting said pair of diverging second score lines.

6. The article carrier of claim 4, wherein at least one of said at least one first score line extends to an edge of said side wall adjoining said plurality of flaps proximate a respective one of top and bottom edges of said side wall, and further comprising a transverse score line in each said side wall parallel to said composite end wall and proximate thereto extending between said top and bottom walls; and a supplementary score line extending from said at least one of said at least one first score line to an intersection of said transverse score line with a respective said one of top and bottom edges of said side wall.

7. The carrier of claim 4 further comprising a hand hole flap foldably attached within said finger-receiving hand-hole aperture of said outermost ones of said plurality of flaps having a plurality of diverging score lines for promoting bending thereof about ones of the cylindrical articles.

8. An article carrier comprising:

a sleeve formed from a plurality of panels foldably joined to one another;

end closure for each end of said sleeve at least one said end closure being a composite wall having a plurality of flaps overlapping in face contacting relationship with one another foldably joined respectively to said plurality of panels and having a handle defined by at least one finger-receiving hand-hole aperture extending through each of said plurality of flaps with said at least one finger-receiving hand-hole aperture in one of said plurality of flaps positioned for coincident alignment with said at least one finger-receiving hand-hole aperture in another of said plurality of flaps, each of said plurality of flaps having a plurality of parallel first score lines extending from at least one region of said finger-receiving hand-hole aperture that is proximate a corner of said flap towards a corner of said composite wall to an edge of said flap, said plurality of parallel first score lines in one of said plurality of flaps positioned for coincident alignment with similarly positioned said plurality of parallel first score lines in another of said plurality of flaps.

9. An article carrier comprising:

a sleeve formed from a top wall and an opposing bottom wall interconnected by opposing side walls; and end closure for each end of said sleeve at least one said end closure being a composite wall having a plurality of flaps overlapping in face contacting relationship with one another foldably joined respectively to said top wall, said opposing bottom wall and said opposing side walls, and having a handle defined by at least one finger-receiving hand-hole aperture extending through each of said plurality of flaps with said at least one finger-receiving hand-hole aperture in one of said plurality of flaps positioned for coincident alignment with said at least one finger-receiving hand-hole aperture in another of said plurality of flaps, each of said plurality of flaps having at least one first score line extending from a region of said finger-receiving hand-hole aperture that is proximate a corner of said flap towards a corner of said composite wall to an edge of said flap, said at least one first score line in one of said plurality of flaps positioned for coincident alignment with a similarly positioned said at least one first score line in another of said plurality of flaps, wherein at least one of said at least one first score lines extends to an edge of said side wall adjoining said plurality of flaps proximate a respective one of top and bottom edges of said side wall;

a transverse score line in each said side wall parallel to said composite wall and proximate thereto extending between said top and bottom walls; and a supplementary score line extending from said one of said at least one first score line extending from said region of said finger-receiving hand-hole aperture that is proximate a corner of said flap to an edge of said side wall adjoining said plurality of flaps proximate a respective one of top and bottom edges thereof to an intersection of said transverse score line with a respective said one of top and bottom edges of said side wall;

wherein said at least one finger-receiving hand hole aperture is elongated having a longitudinal axis parallel to said top and bottom walls; and wherein outermost ones of said composite wall flaps have a pair of diverging second score lines mediate said at least one first score line, said pair of diverging second score lines extending from said at least one finger-receiving hand hole aperture to an edge of intersection of said outermost ones of said composite wall flaps and respective said top and bottom walls.

* * * * *